US008477069B2

(12) United States Patent
Hsieh et al.

(10) Patent No.: US 8,477,069 B2
(45) Date of Patent: Jul. 2, 2013

(54) PORTABLE ELECTRONIC DEVICE AND ANTENNA THEREOF

(75) Inventors: Shih-Wei Hsieh, Taipei (TW); Shyh-Tirng Fang, Tai-Nan (TW)

(73) Assignee: Mediatek Inc,., Hsin-Chu, Taiwan (TW)

( * ) Notice: Subject to any disclaimer, the term of this patent is extended or adjusted under 35 U.S.C. 154(b) by 631 days.

(21) Appl. No.: 12/624,539

(22) Filed: Nov. 24, 2009

(65) Prior Publication Data

US 2011/0043421 A1 Feb. 24, 2011

Related U.S. Application Data

(60) Provisional application No. 61/235,763, filed on Aug. 21, 2009.

(51) Int. Cl.
*H01Q 1/38* (2006.01)

(52) U.S. Cl.
USPC ..... 343/700 MS; 343/843; 343/842

(58) Field of Classification Search
None
See application file for complete search history.

(56) References Cited

U.S. PATENT DOCUMENTS

| | | | | |
|---|---|---|---|---|
| 6,195,048 | B1 | 2/2001 | Chiba et al. | |
| 6,496,148 | B2 | 12/2002 | Ngounou Kouam et al. | |
| 6,734,825 | B1 * | 5/2004 | Guo et al. | 343/700 MS |
| 6,917,335 | B2 * | 7/2005 | Kadambi et al. | 343/700 MS |
| 7,183,982 | B2 * | 2/2007 | Kadambi et al. | 343/702 |
| 7,342,545 | B2 | 3/2008 | Huynh et al. | |
| 7,504,998 | B2 | 3/2009 | Choi et al. | |
| 2004/0070537 | A1 * | 4/2004 | Kadambi et al. | 343/700 MS |
| 2004/0085244 | A1 | 5/2004 | Kadambi et al. | |
| 2004/0252061 | A1 | 12/2004 | Vance | |
| 2006/0244664 | A1 | 11/2006 | Shin et al. | |
| 2007/0247386 | A1 | 10/2007 | Lee et al. | |
| 2008/0231531 | A1 | 9/2008 | Wang et al. | |
| 2008/0303731 | A1 * | 12/2008 | Wu et al. | 343/767 |
| 2009/0051595 | A1 * | 2/2009 | Wang et al. | 343/700 MS |
| 2012/0176291 | A1 * | 7/2012 | Hsueh | 343/843 |

FOREIGN PATENT DOCUMENTS

FR 2 811 479 1/2002

OTHER PUBLICATIONS

FCC Consumer Facts "Hearing Aid Compatibility for Wireless Telephones;" HAC 1988; 8.10.2008; pp. 1-6.

Wong K.L.; "Planar Antennas for Wireless Communications;" 2003; pp. 1-26.

Salonen, P., et al.; "New Slot Configurations for Dual-Band Planar Inverted-F Antenna;" Microwave and Optical Technology Letters; vol. 28; Issue 5; Mar. 5, 2001; pp. 293-298.

* cited by examiner

*Primary Examiner* — Trinh Dinh

(74) *Attorney, Agent, or Firm* — McClure, Qualey & Rodack, LLP

(57) ABSTRACT

An antenna is provided. The antenna includes a radiator, a feed conductor and a ground conductor. The radiator includes a body and a parasitic element. An aperture is formed on the body, and the body encloses the aperture. The parasitic element is connected to the body and extended into the aperture, wherein the parasitic element is connected to the body at a parasitic location. The feed conductor is connected to the body, wherein a signal, fed to the body by the feed conductor, travels on the body, and passes the parasitic location to the parasitic element. The ground conductor is connected to the body.

20 Claims, 6 Drawing Sheets

PORTABLE ELECTRONIC DEVICE AND ANTENNA THEREOF

CROSS REFERENCE TO RELATED APPLICATIONS

This application claims the benefit of provisional Application No. 61/235,763, filed Aug. 21, 2009.

BACKGROUND OF THE INVENTION

1. Field of the Invention

The present invention relates to a portable electronic device, and in particular relates to a portable electronic device satisfying HAC requirements with a decreased SAR value.

2. Description of the Related Art

SAR and HAC are indices that measure the extent of radiation influence upon human health and hearing aid equipment, respectively. A high SAR value resulting from electromagnetic wave radiation may cause human health problems. Thus, mobile phones must pass SAR requirements (e.g. FCC & CE requirements). Mobile phones with excessive HAC values hinder audiphone's functions. Thus, 50% of the mobile phones sold in North America by a manufacturer must pass HAC requirements.

To pass SAR and HAC requirements, several conventional solutions are applied in mobile phone design: (a) board end power or antenna radiation efficiency is decreased to reduce radiation energy; (b) electric field distribution is modified by adding a metal element corresponding to an antenna; or (c) the antenna is disposed away from a radiation interference area thereof (e.g. away from amplifier.) However, the conventional solutions may deteriorate communications quality, reduce design flexibility, or increase hardware costs.

BRIEF SUMMARY OF THE INVENTION

A detailed description is given in the following embodiments with reference to the accompanying drawings.

An antenna is provided. The antenna includes a radiator, a feed conductor and a ground conductor. The radiator includes a body and a element. An aperture is formed on the body, and the body encloses the aperture. The element is connected to the body and extended into the aperture, wherein the element is connected to the body at a location. The feed conductor is connected to the body, wherein a signal, fed to the body by the feed conductor, travels on the body, and passes the location to the element. The ground conductor is connected to the body.

In one embodiment, a path length from the feed conductor to the location is $1/4\lambda$, wherein $\lambda$ is a wavelength of the signal.

In another embodiment, a path length from the feed conductor to the location is $1/2\lambda$, wherein $\lambda$ is a wavelength of the signal.

In one embodiment, a portable electronic device is provided, wherein the feed conductor and the ground conductor electrically connect the body (antenna) to a circuit board thereof, and the antenna modifies an electric field distribution of the circuit board.

The antenna of the embodiment of the invention modifies an electric field distribution on a ground layer of a circuit board, and reduces the electric field intensity around the amplifier to improve HAC and SAR performance. In one embodiment of the invention, the HAC performance can be improved to level M3 (68.5 V/m). Additionally, the antenna can be disposed near the amplifier of a portable electronic device, without negatively effecting HAC requirement of the portable electronic device.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
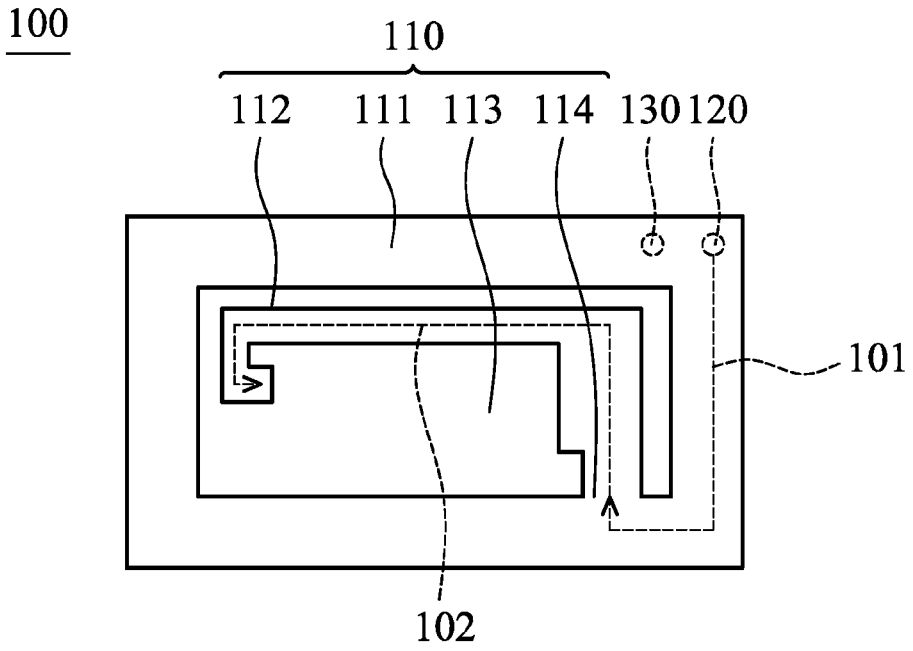
FIG. 1A shows an antenna of a first embodiment of the invention transmitting a first signal.

FIG. 1A shows an antenna 100 of a first embodiment of the invention transmitting a first signal. With reference to FIG. 1A, the antenna 100 comprises a radiator 110, a feed conductor 120 and a ground conductor 130. The radiator 110 comprises a body 111 and a element 112. An aperture 113 is formed on the body 111, and the body 111 encloses the aperture 113. The element 112 is connected to the body 111 and extended into the aperture 113, wherein the element 112 is connected to the body 111 at a location 114. The feed conductor 120 is connected to the body. The first signal (for example, high frequency signal ranging from 1700 MHz to 3000 MHz), fed to the body by the feed conductor 120, travels on the body 111 along a resonance path 101, passes the location 114 to the element 112, and travels on the element 112 along a path 102. The ground conductor 130 is connected to the body 111. A path length from the feed conductor to the location (path length of the resonance path 101) is $1/4\lambda$, wherein $\lambda$ is a wavelength of the first signal.

Figure 1B:
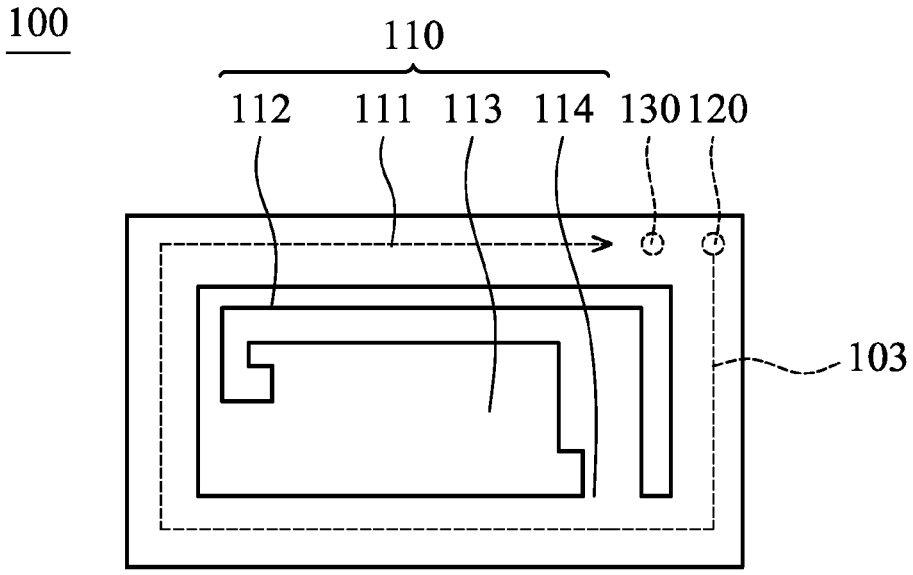
FIG. 1B shows the antenna of the first embodiment of the invention transmitting a second signal.

FIG. 1B shows the antenna 100 of the first embodiment of the invention transmitting a second signal. With reference to FIG. 1B, the second signal (for example, low frequency signal ranging from 800 MHz to 1000 MHz), fed to the body by the feed conductor 120, travels on the body 111 along a resonance path 103 enclosing the aperture 113.

Figure 2:
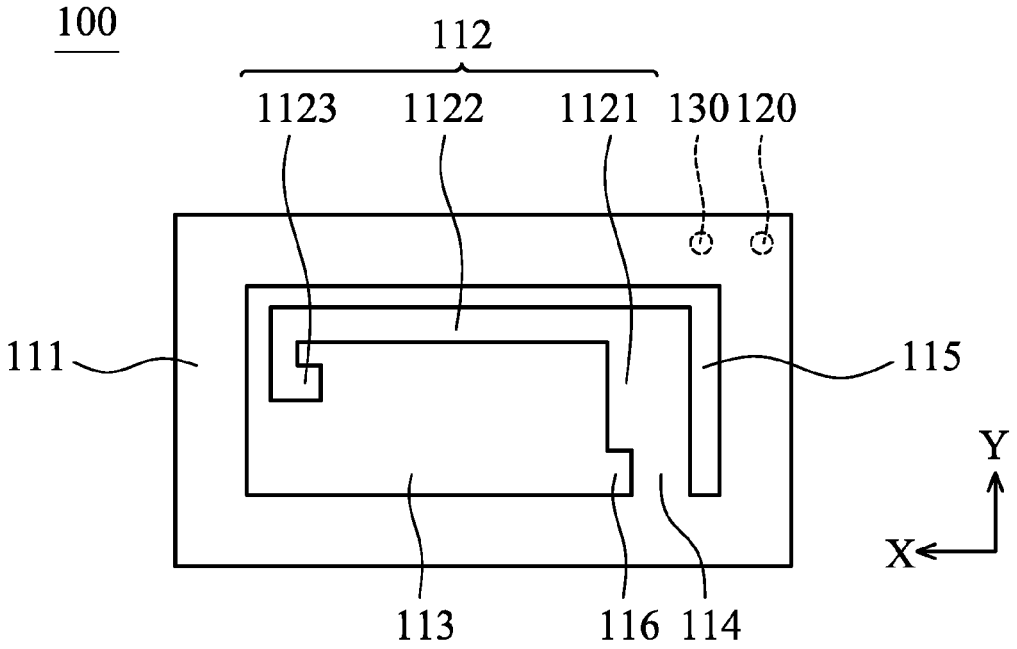
FIG. 2 shows detailed structure of a element of the first embodiment of the invention.

With reference to FIG. 2, the element 112 is substantially L-shaped. The element 112 comprises a first section 1121 and a second section 1122, the first section 1121 is connected to the second section 1122, the first section 1121 extends in a first direction Y, the second section 1122 extends in a second direction X, the first direction Y is perpendicular to the second direction X, and an end of the first section 1121 is connected to the location 114. In this embodiment, a line width of the first section 1121 is greater than a line width of the second section 1122. A slot 115 is formed between the element 112 and the body 111. The element 112 further comprises a bent portion 1123, and the bent portion 1123 is formed on a free end of the second section 1122. A notch 116 is formed on a side of the element 112 for resistance matching.

Figure 3:
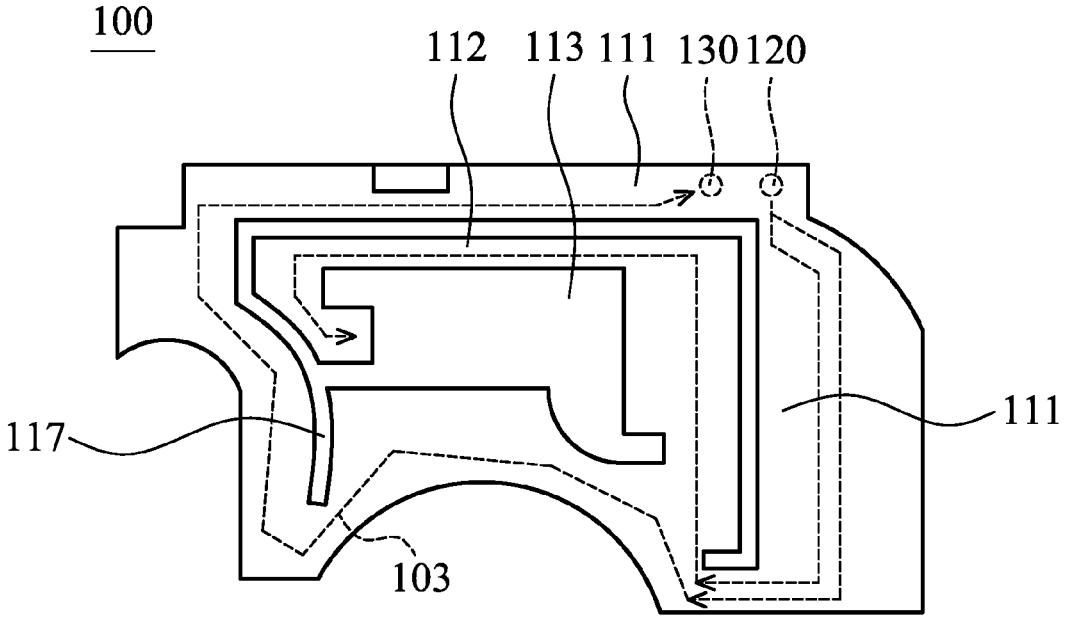
FIG. 3 shows a modified example of the first embodiment.

FIG. 3 shows a modified example of the first embodiment, wherein the shape of the body 111 is modified, and a slot 117 is formed on a side of the body 111 to increase the resonance path 103.

Figure 4A:
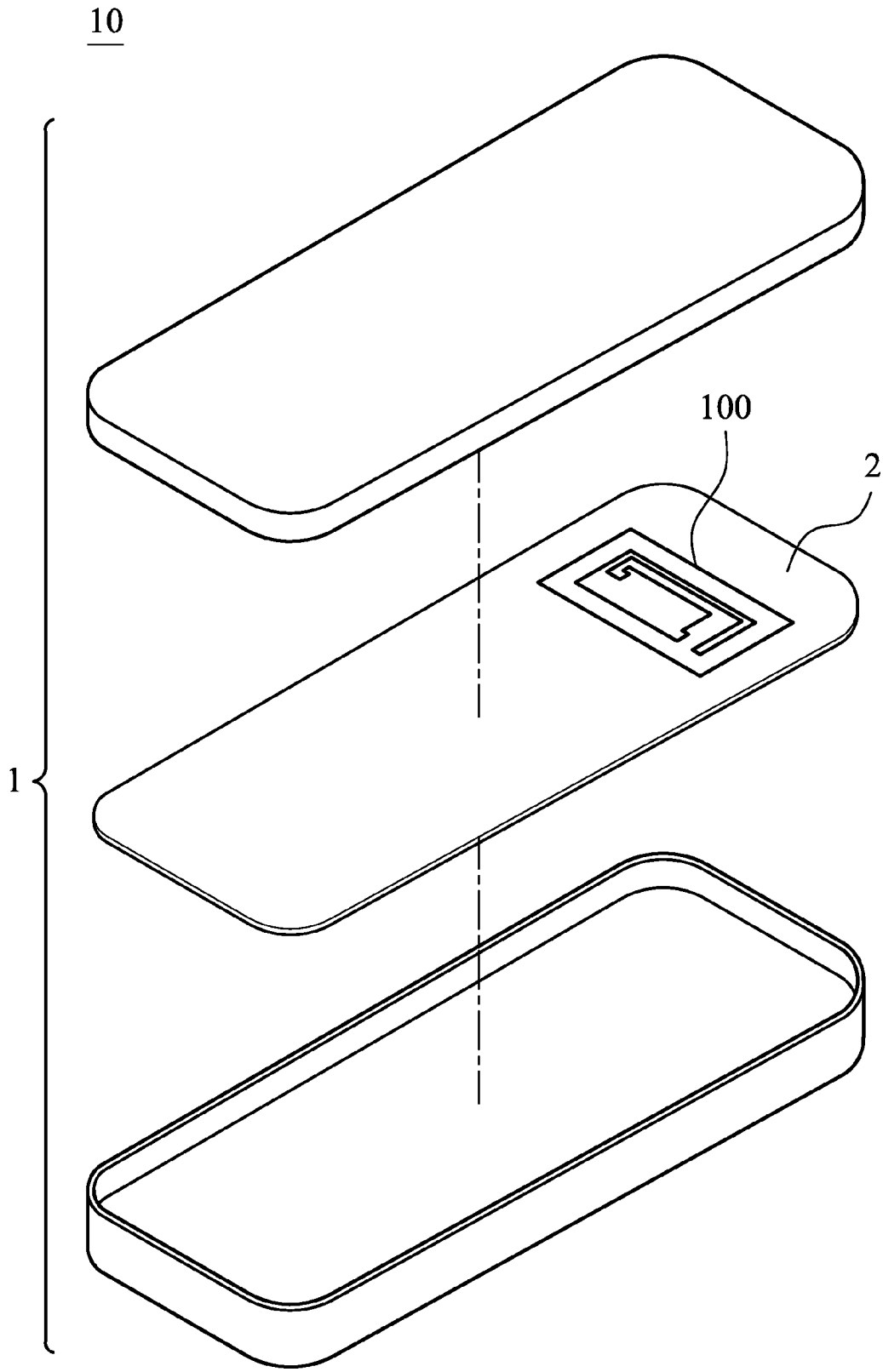
FIG. 4A shows a portable electronic device utilizing the antenna of the embodiment.
Figure 4B:
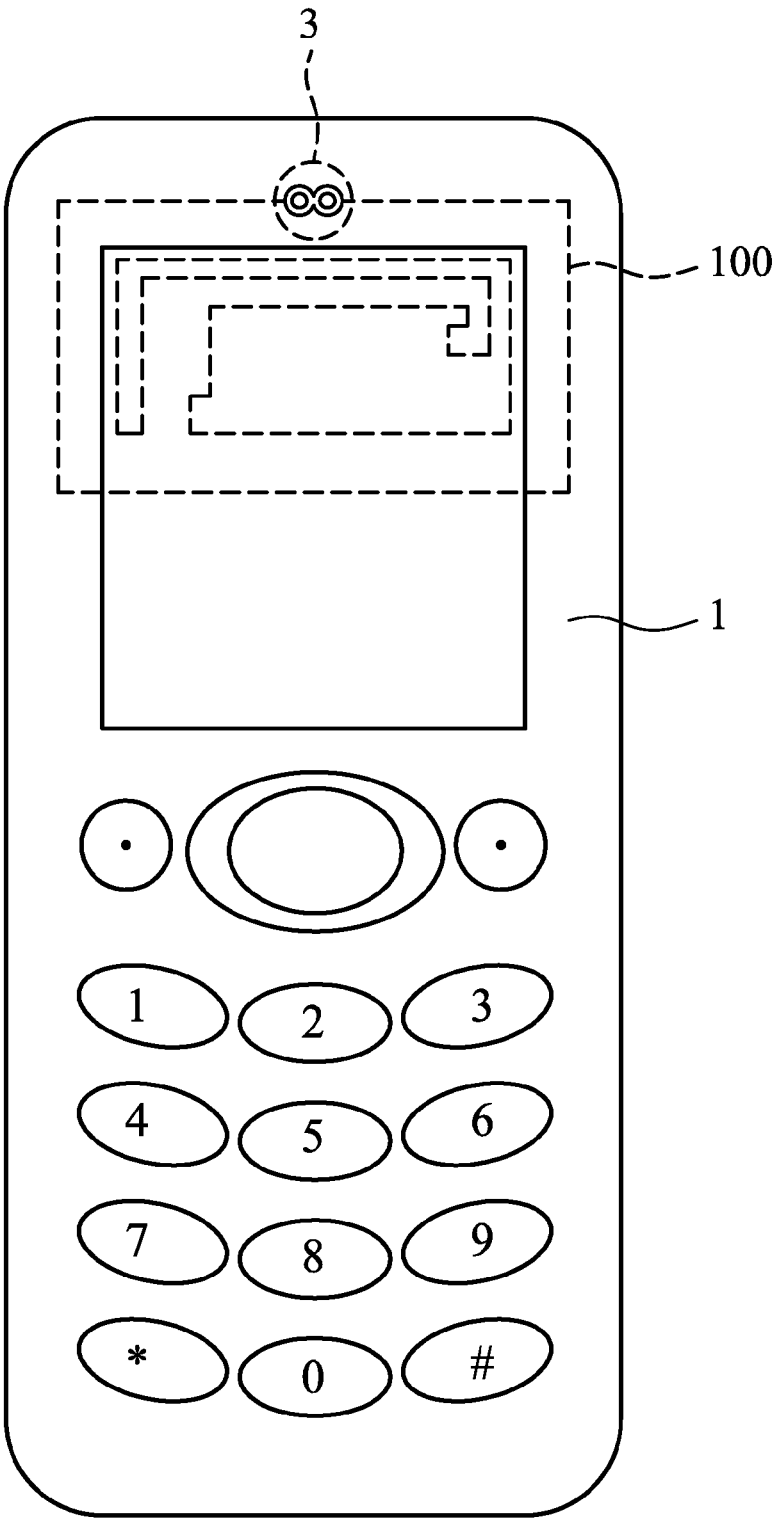
FIG. 4B shows the antenna of the embodiment disposed near an amplifier of the portable electronic device.

FIG. 4A shows a portable electronic device 10 utilizing the antenna 100 of the embodiment. The portable electronic device 10 comprises a housing 1 and a circuit board (print circuit board) 2. The feed conductor and the ground conductor electrically connect the body (antenna 100) to the circuit board 2. The antenna 100 modifies an electric field distribution of the circuit board 2 to reduce an HAC value of the portable electronic device 10. With reference to FIG. 4B, in the embodiment of the invention, the antenna 100 can be disposed near an amplifier 3 of the portable electronic device 10, without negatively effecting HAC recruitment of the portable electronic device 10.

The antenna of the embodiment of the invention modifies an electric field distribution on a ground layer of the circuit board, and reduces the electric field intensity around the amplifier to improve HAC and SAR performance. In one embodiment of the invention, the HAC performance can be improved to level M3 (68.5 V/m). Additionally, the antenna can be disposed near the amplifier of the portable electronic device, without negatively effecting HAC recruitment of the portable electronic device.

Figure 5A:
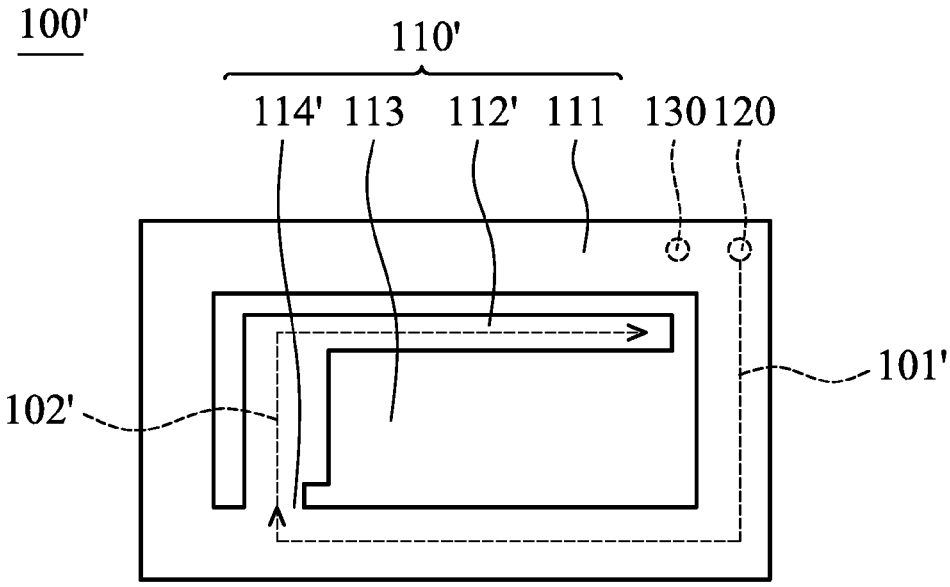
FIG. 5A shows an antenna of a second embodiment of the invention transmitting a first signal.

FIG. 5A shows an antenna 100' of a second embodiment of the invention transmitting a first signal. With reference to FIG. 5A, the antenna 100' comprises a radiator 110', a feed conductor 120 and a ground conductor 130. The radiator comprises a body 111 and a element 112'. An aperture 113 is formed on the body 111, and the body 111 encloses the aperture 113. The element 112' is connected to the body 111 and extended into the aperture 113, wherein the element 112' is connected to the body 111 at a location 114'. The feed conductor 120 is connected to the body. The first signal (high frequency signal), fed to the body by the feed conductor 120, travels on the body 111 along a resonance path 101', passes the location 114' to the element 112', and travels on the element 112' along a path 102'. The ground conductor 130 is connected to the body 111. A path length from the feed conductor 120 to the location 114' (path length of the resonance path 101') is 1/2λ, wherein λ is a wavelength of the first signal.

Figure 5B:
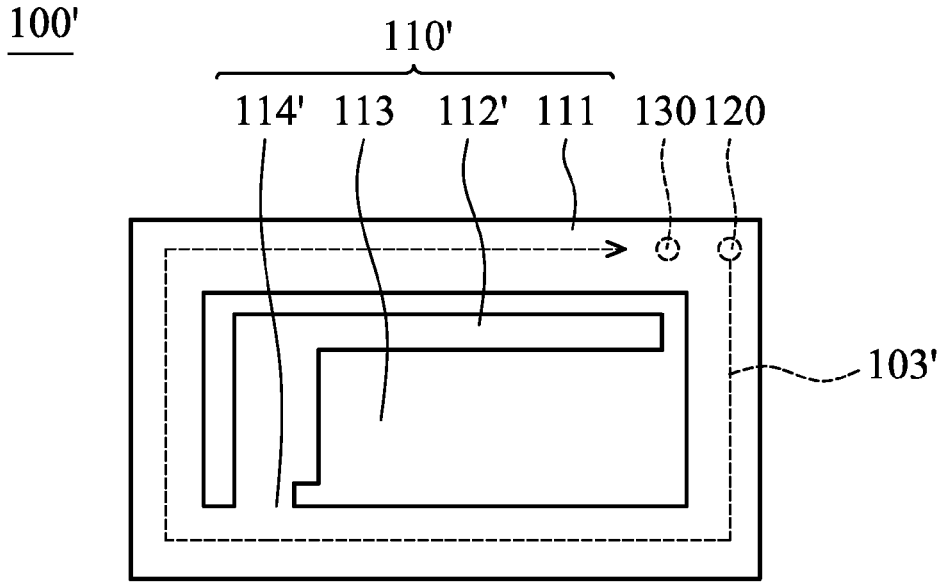
FIG. 5B shows the antenna of the second embodiment of the invention transmitting a second signal.

FIG. 5B shows the antenna 100' of the second embodiment of the invention transmitting a second signal. With reference to FIG. 5B, the second signal (low frequency signal), fed to the body by the feed conductor 120, travels on the body 111 along a resonance path 103' enclosing the aperture 113.

Figure 6:
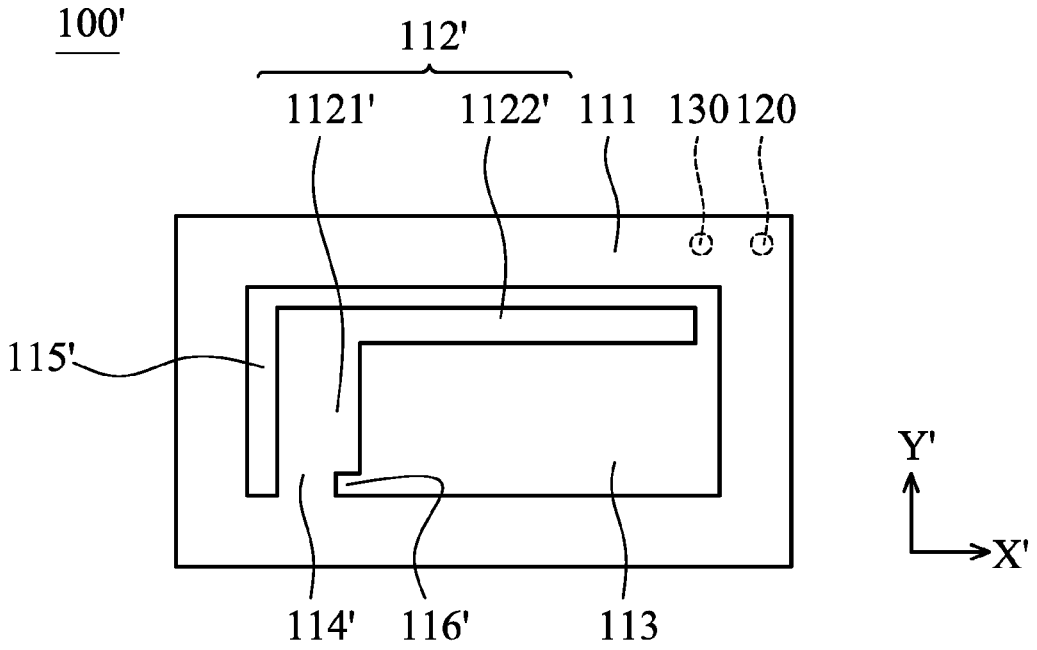
FIG. 6 shows detailed structure of a element of the second embodiment of the invention.

With reference to FIG. 6, similar to the first embodiment, the element 112' is substantially L-shaped. The element 112' comprises a first section 1121' and a second section 1122', the first section 1121' is connected to the second section 1122', the first section 1121' extends in a first direction Y', the second section 1122' extends in a second direction X', the first direction Y' is perpendicular to the second direction X', and an end of the first section 1121' is connected to the location 114'. In this embodiment, and a line width of the first section 1121' is greater than a line width of the second section 1122'. A slot 115' is formed between the element 112' and the body 111. A notch 116' is formed on a side of the element 112' for resistance matching.

Figure 7:
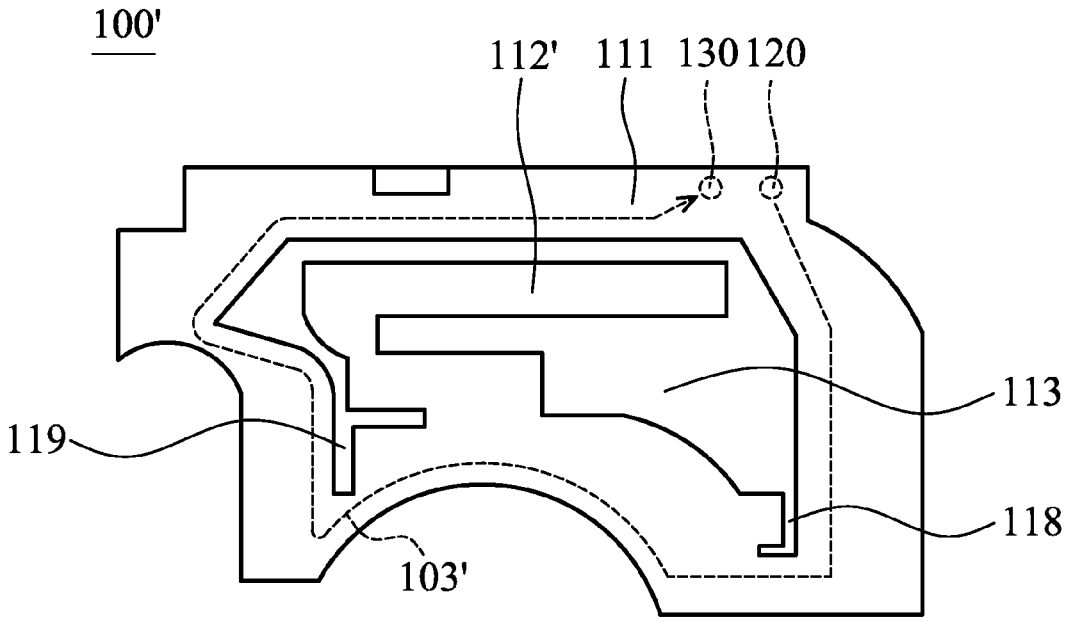
FIG. 7 shows a modified example of the second embodiment.

FIG. 7 shows a modified example of the second embodiment, wherein the shape of the body 111 is modified, and a slot 118 and a slot 119 are formed on a side of the body 111 to increase the resonance path 103'.

Resistance matching and bandwidth of the antenna of the invention can be modified by changing the shapes of the body, the aperture and the element. The path length from the feed conductor to the location can be within a range from 1/2λ to 1/4λ.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a radiator, comprising:

a body, wherein an aperture is formed on the body, and the body encloses the aperture; and an element, connected to the body and extended into the aperture, wherein the element is connected to the body at a location;

a feed conductor, connected to the body, wherein a signal, fed to the body by the feed conductor, travels on the body, and passes the location to the element, wherein a path length from the feed conductor to the location is within a range from 1/2λ to 1/4λ, wherein λ is a wavelength of the signal; and a ground conductor, connected to the body.

2. The antenna as claimed in claim 1, wherein a slot is formed between the element and the body.

3. The antenna as claimed in claim 1, wherein a path length from the feed conductor to the location is 1/4λ.

4. The antenna as claimed in claim 3, wherein the element is substantially L-shaped.

5. The antenna as claimed in claim 3, wherein the element comprises a first section and a second section, the first section is connected to the second section, the first section extends in a first direction, the second section extends in a second direction, the first direction is perpendicular to the second direction, and an end of the first section is connected to the location.

6. The antenna as claimed in claim 5, wherein a line width of the first section is greater than a line width of the second section.

7. The antenna as claimed in claim 5, wherein the element further comprises a bent portion, and the bent portion is formed on a free end of the second section.

8. The antenna as claimed in claim 3, wherein a notch is formed on a side of the element.

9. The antenna as claimed in claim 1, wherein a path length from the feed conductor to the location is 1/2λ.

10. The antenna as claimed in claim 9, wherein the element is substantially L-shaped.

11. The antenna as claimed in claim 9, wherein the element comprises a first section and a second section, the first section is connected to the second section, the first section extends in a first direction, the second section extends in a second direction, the first direction is perpendicular to the second direction, and an end of the first section is connected to the location.

12. A portable electronic device, comprising:

an antenna, comprising:

a radiator, comprising:

a body, wherein an aperture is formed on the body, and the body encloses the aperture; and an element, connected to the body and extended into the aperture, wherein the element is connected to the body at a location;

a feed conductor, connected to the body, wherein a signal, fed to the body by the feed conductor, travels on the body, and passes the location to the element, wherein a path length from the feed conductor to the location is within a range from 1/2λ to 1/4λ, wherein λ is a wavelength of the signal; and a ground conductor, connected to the body; and a circuit board; wherein the feed conductor and the ground conductor electrically connect the body to the circuit board, and the antenna modifies an electric field distribution of the circuit board.

13. The portable electronic device as claimed in claim 12, wherein a slot is formed between the element and the body.

14. The portable electronic device as claimed in claim 12, wherein the element is substantially L-shaped.

15. The portable electronic device as claimed in claim 12, wherein the element comprises a first section and a second section, the first section is connected to the second section, the first section extends in a first direction, the second section extends in a second direction, the first direction is perpendicular to the second direction, and an end of the first section is connected to the location.

16. The portable electronic device as claimed in claim 15, wherein a line width of the first section is greater than a line width of the second section.

17. The portable electronic device as claimed in claim 15, wherein the element further comprises a bent portion, and the bent portion is formed on a free end of the second section.

18. The portable electronic device as claimed in claim 17, wherein a notch is formed on a side of the element.

19. The portable electronic device as claimed in claim 12, wherein the element is substantially L-shaped.

20. The portable electronic device as claimed in claim 12, wherein the element comprises a first section and a second section, the first section is connected to the second section, the first section extends in a first direction, the second section extends in a second direction, the first direction is perpendicular to the second direction, and an end of the first section is connected to the location.

* * * * *